United States Patent [19]

Johnson

[11] Patent Number: 4,519,151

[45] Date of Patent: May 28, 1985

[54] EXPANDABLE AND CONTRACTIBLE FRAME FOR STRETCHING FABRIC MATERIAL, AND METHOD

[75] Inventor: Robert C. Johnson, Chagrin Falls, Ohio

[73] Assignee: Metalogic, Inc., Chagrin Falls, Ohio

[21] Appl. No.: 548,412

[22] Filed: Nov. 3, 1983

[51] Int. Cl.[3] ..... D06C 3/08

[52] U.S. Cl. ..... 38/102.9; 160/374.1

[58] Field of Search ..... 160/374.1, 372, 374, 160/375, 377, 378, 381; 38/102.1, 102.3, 102.9, 102.4, 102.5, 102.6, 102.8; 40/155

[56] References Cited

U.S. PATENT DOCUMENTS

| | | | |
|---|---|---|---|
| 69,447 | 10/1867 | Kellogg | 160/374.1 X |
| 988,554 | 4/1911 | Donnell et al. | 38/102.8 |
| 1,398,869 | 11/1921 | Le Roy | 160/374 |
| 2,413,041 | 12/1946 | Ferguson | 38/102.1 |
| 2,673,418 | 3/1954 | Unwin | 38/102.91 |
| 2,840,161 | 6/1958 | Alexander et al. | 160/377 |
| 3,583,466 | 6/1971 | Dreyer | 160/377 |
| 3,924,343 | 12/1975 | Johnson | 160/374.1 |
| 4,144,660 | 3/1979 | Lamb | 38/102.5 |

FOREIGN PATENT DOCUMENTS

| | | | |
|---|---|---|---|
| 581549 | 7/1933 | Fed. Rep. of Germany | 160/374.1 |

*Primary Examiner*—Peter M. Caun
*Assistant Examiner*—Cherney S. Lieberman
*Attorney, Agent, or Firm*—Baldwin, Egan, Walling & Fetzer

[57] ABSTRACT

A lightweight frame for stretching or blocking fabric material comprising elongated metal side frame elements detachably coupled together at their adjacent ends by a coacting pair of corner elements which are selectively expandably movable and contractibly movable relative to one another, so as to increase or decrease the frame size. Rotatable actuators coacting with the corner elements provide for the selective expansion and contraction of the corner elements relative to one another, to thereby cause said expansion and contraction of the frame. By providing a series of different lengths of side frame elements, substantially different frame sizes can be expeditiously provided. The paired corner elements and the coacting side frame elements have means thereon for rapidly detachably coupling the frame and corner elements together, as well as for rapidly securing fabric material to and removing fabric material from the frame proper. The various parts for forming various frame sizes can be expeditiously packaged in kit form. The frame is particularly adapted for stretching painters' canvas and artistic needlework, and the component parts are preferably made of anti-corrosion metallic material (e.g. aluminum).

8 Claims, 14 Drawing Figures

EXPANDABLE AND CONTRACTIBLE FRAME FOR STRETCHING FABRIC MATERIAL, AND METHOD

This invention relates in general to a device and method for stretching material such as for instance canvas or other fabric for use, for instance, in painting, needlework or the like, and more particularly relates to a lightweight expandable and contractible frame which includes a series of sizes of elongated metal frame elements adapted for coupling together at their corners or ends by paired corner elements which in turn are selectively expandable and contractible relative to one another, so as to increase or decrease the frame size, together with rotatable actuating means coacting with the corner elements, for selective expansion and contraction of such corner elements, to thereby cause the expansion and contraction of the frame.

BACKGROUND OF THE INVENTION

There are many methods and devices in the art for providing a taut surface on fabric material. One of these is applicant's U.S. Pat. No. 3,924,343 issued Dec. 9, 1975 on Expansible Device for Stretching Material and Method. The present arrangement provides an improved stretching device for fabric and the like, as compared to applicant's said prior patent.

U.S. Pat. No. 2,565,218 issued Aug. 21, 1951 to Freeborn discloses an adjustable frame for use in silk screen printing wherein the frame elements are formed of metal, such as aluminum. Such Freeborn frame is extremely complex and considerably more expensive than applicant's adjustable frame arrangement.

U.S. Pat. No. 3,451,153 issued June 24, 1969 to Dohanyos discloses an adjustable framing device so constructed and arranged that a single frame can accommodate a variety of different size members for enclosing the same, and therefore could be referred to as a generally "universal type" adjustable frame. The Donanyos frame is adapted for enclosing various sizes of pictures or door openings.

Various other prior art is also cited in applicant's aforementioned in U.S. Pat. No. 3,924,343, and such prior art is incorporated herein by reference.

SUMMARY OF THE INVENTION

The present invention provides a novel lightweight frame for stretching or blocking fabric material, and comprising elongated metal side frame elements, detachably coupled together at their adjacent ends by a coacting pair of corner elements which are selectively expandable and contractible with respect to one another so as to increase or decrease the frame size, together with rotatable actuators coacting with the corner elements, and providing for the selective expansion and contraction of the corner elements relative to one another, to thereby cause said expansion and contraction of the frame. A series of different lengths of side frame elements are preferably provided, so that considerably different sizes of frames can be readily constructed from the provided series. The side frame elements have means thereon adapted to receive fasteners for rapidly securing as well as rapidly releasing the fabric material to and from the frame proper, and the metal frame elements are preferably made of corrosion resistant, metallic material, so that corrosion will not occur when wet or dampened fabric is secured to or supported on the lightweight but high strength frame.

Accordingly, an object of the invention is to provide a novel, lightweight frame for stretching material secured thereto, and a frame particularly adapted for stretching or blocking artistic needlework or painters' canvas.

Another object of the invention is to provide a device of the aforementioned type which is comprised of a plurality of metal side frame elements formed of tubing, with means for detachably securing the metal side frame elements to a coacting pair of corner elements, and rotatable, threaded actuating members coacting with and between the respective pair of corner elements are provided for causing expansion and retraction of the respective pair of corner elements relative to one another, thereby providing for expansion or contraction of the frame and the respective stretching or slackening of the fabric material secured to the frame.

A still further object of the invention is to provide a device of the aforementioned type wherein there is provided a series of different lengths of side frame elements so that considerably different frame sizes can be expeditiously provided, for stretching considerably different sizes of fabric pieces.

A further object of the invention is to provide a novel method for stretching fabric material by attaching the fabric along its edges by fasteners extending through the fabric and into coacting openings in the side frame members of the lightweight frame, and then rotating threaded actuating means coacting between each pair of corner elements, to provide for expansion movement of the respective pair of corner elements relative to one another, thus providing for expansion of the frame and resultant stretching of the fabric material secured thereto.

Other objects and advantages of the invention will be apparent from the following description taken in conjunction with the accompanying drawings wherein:

DESCRIPTION OF PREFERRED EMBODIMENT AND ALTERNATE EMBODIMENT

Figure 1:
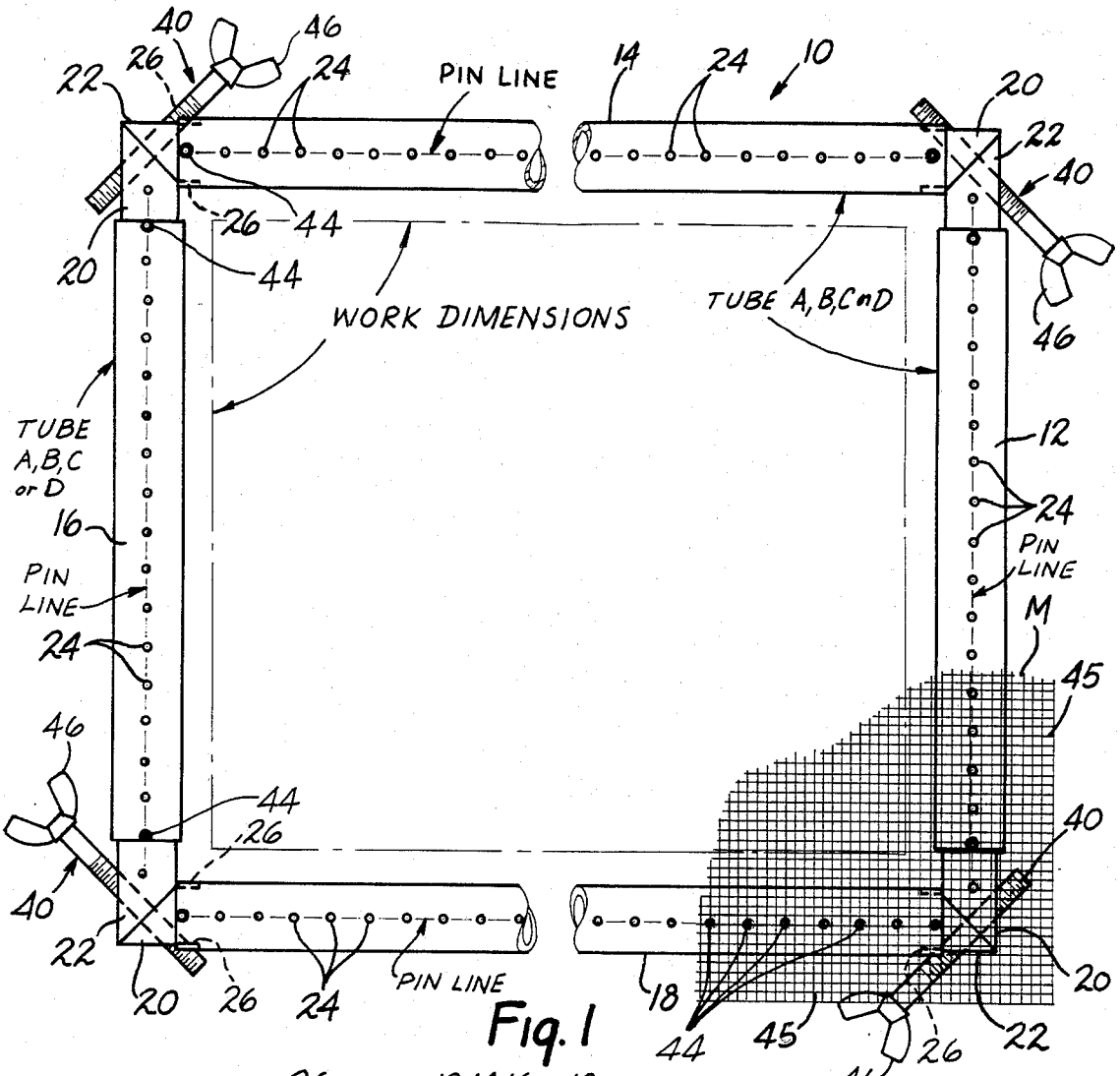
FIG. 1 is a plan view of a lightweight expandable frame, constructed in accordance with the invention.

Referring now again to the drawings, there is shown in FIG. 1 an expandable and retractable lightweight fabric material stretching frame 10, embodying the invention.

Frame 10 comprises side frame elements 12, 14, 16 and 18, connected at their adjacent ends by a pair of corner elements 20 and 22.

Figure 2:
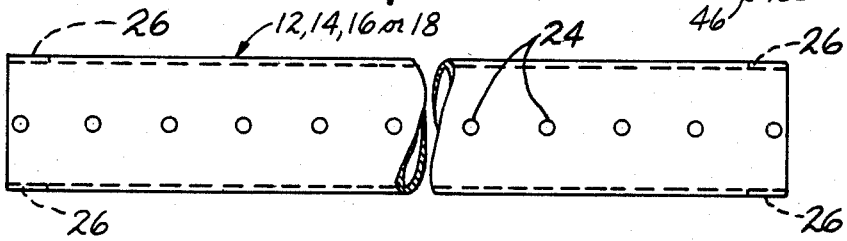
FIG. 2 is an enlarged, broken illustration of one of the tubular side frame elements utilized to construct the lightweight stretching frame of FIG. 1, taken from the top side thereof.
Figure 4:
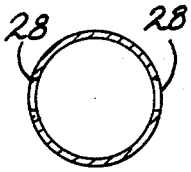
FIG. 4 is a sectional view of the tubular member illustrated in FIG. 3, taken generally along the plane of line 4—4 thereof, looking in the direction of the arrows.
Figure 3:
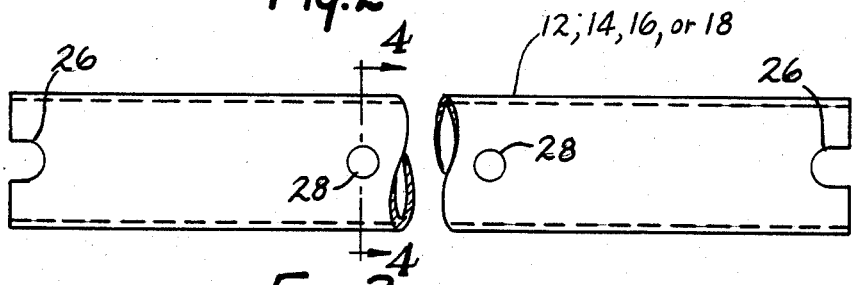
FIG. 3 is a view generally similar to that of FIG. 2 except that the tube has been rotated about its lengthwise axis 90° to illustrate the side thereof.

Each of the side frame elements 12, 14, 16 and 18, in the embodiment illustrated, comprises a piece of lightweight metallic tubing, such as for instance aluminum alloy 6061-T-6 tubing, having a series of spaced openings 24 extending transversely inwardly of the exterior surface of the tubing into communication with the hollow interior of the tubing, with openings 24 being spaced lengthwise along the length of the respective side element, and as shown for instance in FIGS. 1 and 2. Openings 24 are adapted for use in attaching or fastening the fabric material to the frame as will be hereinafter described in greater detail. As can be best seen in FIG. 3, each end of each side frame element 12, 14, 16 or 18 is grooved or recessed as at 26 on both the inner and outer sides thereof, and for a purpose to be hereinafter described. Openings 28 may be provided through one side of the side frame elements, for removably mounting the frame on an optional workstand (not shown).

Each of the corner elements 20, 22 is preferably formed of lightweight metal, such as for instance aluminum alloy, and comprises a member which is beveled as at 30 at one end thereof, and preferably at an angle of approximately 45° with respect to the longitudinal axis of the respective corner member, thus providing a generally flat exterior obliquely arranged surface 30*a*, while at the other end of the corner member, the defining boundary 31 thereof extends transversely of the lengthwise or longitudinal axis of the respective member, and at an angle of approximately 90° with respect to the lengthwise axis of the corner member. From said transverse boundary 31, the corner member is hollowed out or recessed as at 32 with such recess extending for a predetermined extent into the respective corner member.

Figure 10:
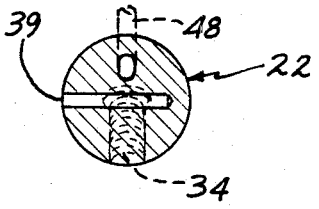
FIG. 10 is a sectional view taken generally along the plane of line 10—10 of FIG. 9, looking in the direction of the arrows.

Extending inwardly from the obliquely arranged surface 30*a*, is a threaded opening 34 which extends generally perpendicular from surface 30*a* completely through the corner member body, and opening onto the cylindrical exterior of the corner member. Also, disposed in surface 30*a*, is a passageway 36 extending approximately perpendicular with respect to surface 30*a* and generally parallel to associated threaded opening 34, and extending completely through the body of the corner member and preferably into communication with the aforementioned recess 32 in the corner member body. Corner members 20 and 22 also are provided with a plurality of openings 38 therein spaced lengthwise of the respective corner member and communicating with the aforementioned recess 32. Opening 39 also is preferably provided extending transverse of the corner member but which does not extend completely therethrough as illustrated for instance in FIG. 10.

The corner members 20, 22 as aforementioned are adapted to be utilized in pairs, and a threaded fastener actuator 40 (FIGS. 1 and 5) coacts with the respective pair of corner members in threaded relationship therewith, and couples the pair of corner members together while providing for expansion and contraction of the corner members relative to one another upon threaded rotation of the actuator member 40. In this connection, one of the corner members (e.g. 20) in its opening or passageway 34 therein possesses a righthand thread, while the other (e.g. 22) of the corner members of each pair thereof in its opening 34, possesses a lefthand thread. Likewise the respective rotary actuator member 40 comprises two thread sections (FIG. 5) 42 and 44, one of which is a righthand threaded section, and the other of which is a lefthand threaded section. When the rotatable actuator member is assembled with the respective pair of corner members in the respective threaded opening 34 in the paired corner members, upon rotation of the actuator member 40 as by means of the handle or wing nut 46 fixed thereon, the corner members of each pair are caused to expand or contract relative to one another depending upon the direction of rotation of the respective actuator 40, to thereby cause expansion or contraction of the frame and thus causing the material M (FIG. 1) attached to the frame to be stretched or slackened. Corner members 20, 22 may be detachably coupled to the associated side frame element 12, 14, 16 or 18 by means of a pointed or headed pin (to be hereinafter described in greater detail) passing through one of the end oriented openings 24 in the associated side element and through a respective one of the underlying aligned openings 38, 39 in the body of the corner element. Openings 24 are preferably approximately ½ inch apart, and the diameter of each opening 38 is preferably slightly greater than the diameter of openings 24, for facilitating assembly of the aforementioned pins.

Figure 10A:
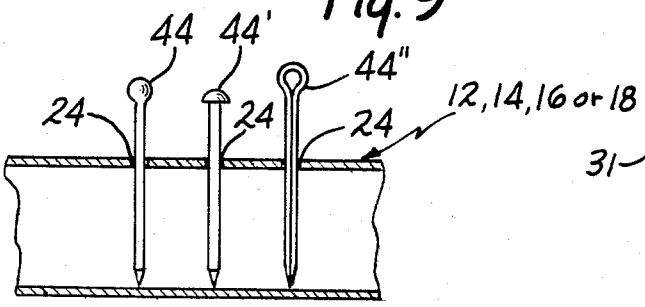
FIG. 10A is an enlarged sectional, fragmentary view of one of the side frame elements with a variety of headed pins that can be used for attaching the corner elements to the side frame elements as well as for attaching the fabric to the frame.

Attaching of the fabric material to the frame is provided for by the aforementioned openings 24 in the side frame elements as well as the openings 38, 39 in the coacting corner elements. Pointed and headed pins e.g. 44 (or 44′ or 44″) (FIG. 10A) are adapted to be inserted through the fabric generally along the exterior boundaries 45 thereof, and into the respective opening 24 in the side frame members and (with respect to the corner portions of the frame) into the underlying aligned opening in the corner elements, to thus releasably attach the fabric to the frame. The fasteners 44 (or 44' or 44") are preferably made of or coated with corrosion resistant material and are preferably received in the respective opening in the side frame and corner elements comparatively snugly, so that while they are readily inserted into and removed from the respective opening 24, 38 or 39, they will not readily freely fall out of the respective opening, thus maintaining the assembly of the fabric with the frame unless intentional removal or separation thereof is desired.

Inserted in each of the aforementioned openings 36 in each of the corner members and coacting with the confronting opening 36 in the adjacent corner member is a guide pin 48 which is adapted to remain in extending relationship between the openings in the corner members of each pair and to guide the corner members toward and away from one another upon rotation of the respective actuator 40, as well as preventing the corner members from twisting or turning relative to one another, thus ensuring a smooth expansion or contraction of the frame 10, upon rotation of the rotatable actuator members 40.

As may be best seen in FIG. 1, when a side frame element is in generally abutting condition (e.g. frame element 14) with the adjacent corner member (e.g. 20) the recess 26 prevents interference between the side frame element and the actuator 40.

Figure 5:
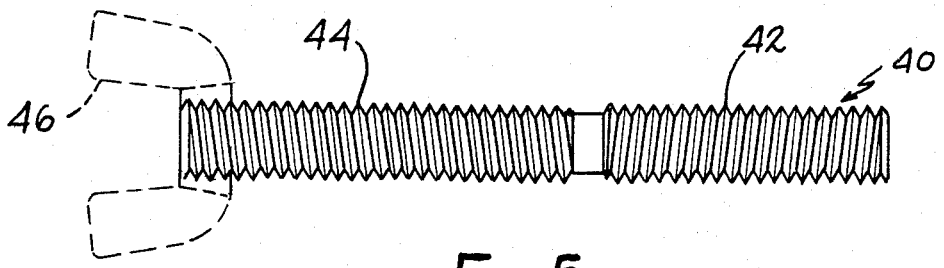
FIG. 5 is an enlarged view of one of the rotatable actuators (without its wing nut thereon) utilized to change the relative position of the corner elements of each pair with respect to one another, to thereby expand or contract the frame proper.
Figure 6:
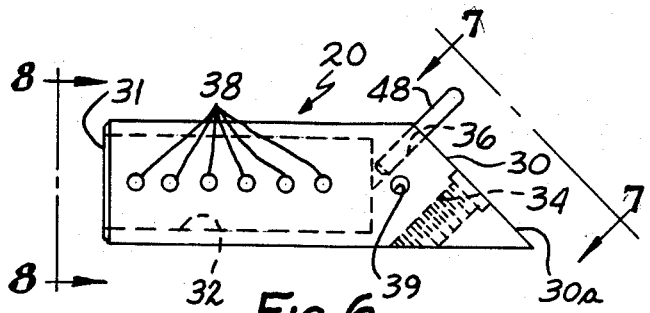
FIG. 6 is a plan view of one of the corner elements of each pair thereof, taken from the top side of the corner element.
Figure 8:
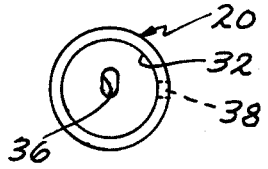
FIG. 8 is an end elevational view of the corner element of FIG. 6 taken generally along the plane of line 8—8 of FIG. 6, looking in the direction of the arrows.
Figure 7:
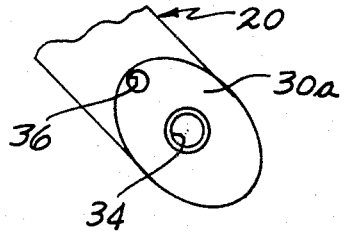
FIG. 7 is a broken elevational view of the corner element of FIG. 6 taken generally along the plane of line 7—7 of FIG. 6, looking in the direction of the arrows.
Figure 9:
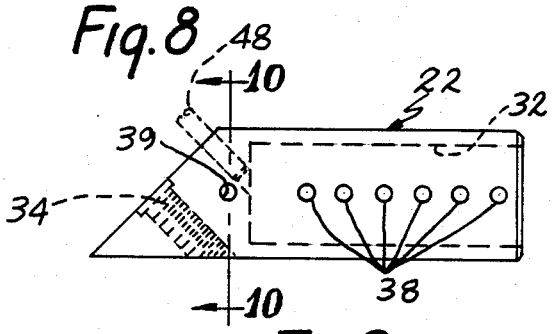
FIG. 9 is an elevational view of the other corner element of each said pair, taken from the top side thereof.
Figure 10B:
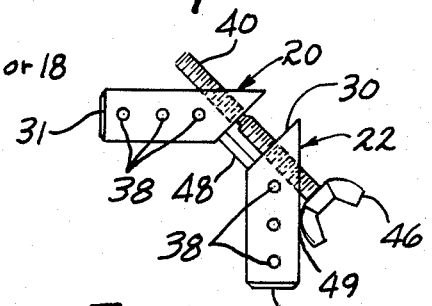
FIG. 10B is a reduced size, top plan of one of the corner element assemblies with its associated rotatable actuator.

The corner components 20 and 22 are preferably permanently assembled together at the factory by inserting anti-rotating pin 48 and screw 40 after which wing nut 46 is assembled in fixed relation to screw 40 using for instance a liquid adhesive, as shown in FIG. 5. The reason for completely assembling the corner units is to prevent the user from over-expanding the corner assembly. This is prevented by limiting the expansion to a predetermined number of turns of the screw, at which point the base of the wing nut impinges as at 49 on the adjacent corner parts 20 or 22 (FIG. 10B) or on the adjacent tube 12, 14, 16 or 18.

Figure 12:
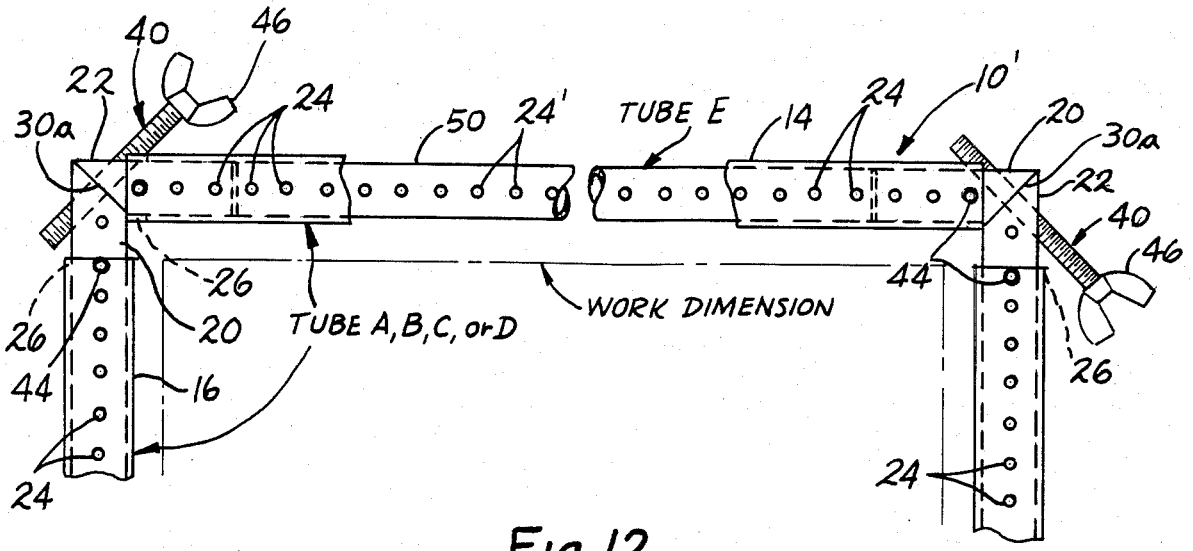
FIG. 12 is a fragmentary view showing another embodiment of the frame as compared to that of FIG. 1 and one wherein an inner tubular side frame element is utilized in conjunction with the usual outer tubular side frame element, for rigidifying an adjustable larger size of frame, for the stretching of larger size fabric pieces thereon.

FIG. 12 illustrates another embodiment of the expandable and contractible frame arrangement when considerable rigidity of the frame is desired and when the frame elements are so chosen from the series of available side frame members so as to substantially increase the size of the frame. In this embodiment, an outer side frame member (e.g. 12, 14, 16 or 18) receives therein a reduced diameter, lightweight metal inner side frame member 50 so as to generally double the wall thickness strength of the side frame members, and thus increase the rigidity of the overall frame. The inner tubular member prefer fits snugly into the coacting outer tubular member and has a series of spaced openings 24' therein which are adapted to align with the openings 24 in the outer side member for receiving fabric fastener pins e.g. 44 therethrough. It is preferable that inner side frame elements 50 be utilized whenever any work dimension (FIG. 1) of the stretching frame exceeds about 14½ inches. In other respects this other embodiment is generally similar to that of the first described embodiment so far as attaching the fabric to the frame is concerned and for expansion and contraction of the frame. The outer diameter of the inner frame members 50 is preferably the same as that of the corner elements 20, 22, and the diameter of openings 24' are preferably slightly greater than that of openings 24 to facilitate pin insertion.

The side frame elements and corner elements and fabric attaching pins 44 of the frame are preferably made of corrosion resistant material, such as the aforementioned aluminum in connection with the side frame and corner elements, and of zinc coated steel in connection with the pins 44, which thereby prevents corrosion of the frame and staining of the attached fabric material, when the fabric material is damp or has been washed and is still wet when attached to the frame.

Figure 11:
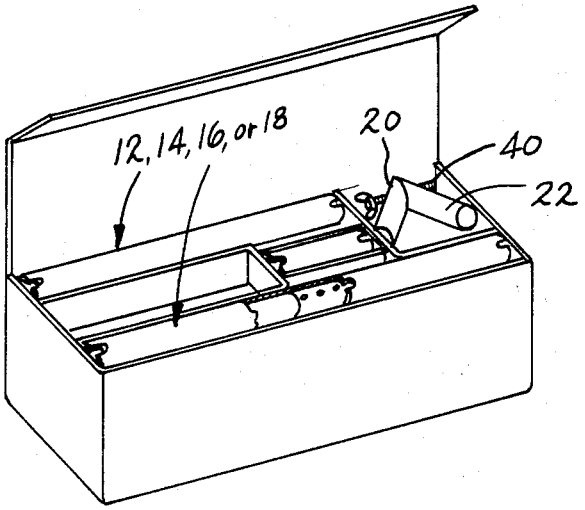
FIG. 11 is a generally perspective partially broken illustration of a set of the corner element assemblies, and of a series of lengths of the side frame elements as packaged in a receptacle, and which side frame elements are adapted for selective use to provide substantially different frame sizes.

FIG. 11 illustrates a container 52, such as for instance a paper-board box, which can contain or package all of the parts, including the aforementioned series of various lengths of side frame elements, for selective use in producing substantially different size stretching frames. Container 52 is preferably a standard size box, having inside measurements of approximately 17½×3½×3½ inches, with cardboard inserts being provided to separate the side frame components of the series and the other stretching frame elements (e.g. the corner members 20, 22, the actuators 40, and the fasteners 44). An example of the work dimension possibilities and the pin line dimension possibilities (FIG. 1) of a preferred series side frame tube series is as follows, with a designation of the tubes preferred referenced by the letters A, B, C, D and E, with reference letter E designating the inner tube 50 utilized with the FIG. 12 embodiment of stretching frame 10. Tube E in the embodiment illustrated is preferably approximately 10¾ inches in length. The main difference between side frame tubes referenced by letters A, B, C and D is of course the lengths thereof.

| WORK DIMENSION | PIN LINE DIMENSION | TUBES |
|---|---|---|
| 3" to 5½" | 5" to 7½" | A |
| 6" to 8½" | 8" to 10½" | B |
| 9" to 11½" | 11" to 13½" | C |
| 12" to 14½" | 14" to 16½" | D |
| 15" to 17½" | 17" to 19½" | A-B-E |
| 18" to 20½" | 20" to 22½" | A-C-E |
| 21" to 23½" | 23" to 25½" | A-D-E |
| 24" to 26½" | 26" to 28½" | B-D-E |
| 27" to 29½" | 29" to 31½" | C-D-E |
| 30" to 32½" | 32" to 34½" | D-D-E |

From the foregoing discussion and accompanying drawings it will be seen that the invention provides a novel lightweight frame for stretching material, such as fabric needlepoint material or painters' canvas, with the frame comprising elongated metal side frame elements coupled together at their adjacent ends by a coacting pair of corner elements, with the corner elements being selectively movable relative to one another so as to increase or decrease the frame size a selected amount, thus causing stretching or slackening of the attached material, together with rotatable actuating means coacting with each pair of the corner elements, providing for selective expansion movement and contraction movement of the respective pair of corner elements relative to one another, to thus provide for the expansion and contraction of the frame and the stretching or slackening of the material secured thereto.

The invention also provides a novel method of stretching material such as for instance painters' canvas or artistic needlework.

The terms and expressions which have been used are used as terms of description, and not of limitation, and there is no intention in the use of such terms and expressions of excluding any equivalents of any of the features shown or described, or portions thereof, and it is recognized that modifications are possible within the scope of the invention claimed.

What is claimed is:

1. A relatively lightweight frame for stretching material, such as fabric material, adapted to be secured thereto, said frame comprising one-piece elongated, metal, defining side frame elements coupled together at their adjacent ends by a coacting pair of corner elements, said corner elements being selectively movable relative to one another so as to increase or decrease the frame size a selected amount, thus causing stretching or slackening of attached material, said side frame elements consisting of tubular members of metallic material, such as for instance aluminum, each of said corner elements of each pair on one end thereof comprising a beveled end surface, with said end surfaces of each said pair being disposed in generally confronting relation, means on said corner elements and on said side frame elements for detachably connecting the respective corner element to the associated side frame element, means on at least said side frame elements for rapidly securing fabric material thereto, the last mentioned means comprising a series of spaced openings in each said side frame element positioned lengthwise of the respective side frame element and adapted to receive therein pins which when passed first through associated fabric material are adapted to attach the fabric material to the frame, and rotatable actuating means coacting with each pair of said corner elements providing for selective expansion movement and contraction movement of the respective pair of corner elements relative to one another, thus providing for expansion and contraction of the frame and the stretching or slackening of material adapted to be secured thereto, said actuating means comprising a rotatable threaded shank provided with lefthand and righthand threaded portions, one of said corner elements of each of said pairs having a righthand threaded opening thereon while the other corner element of each of said pairs has a lefthand threaded opening thereon adapted for coaction with the respective of said righthand and lefthand threaded portions of said shank, thus providing for said expansion movement and retraction movement of the corner elements of each pair relative to one another upon rotation of said shank in a predetermined direction, said threaded openings extending inwardly from the respective of said beveled end surfaces generally perpendicularly thereto whereby said shank is disposed generally perpendicular to the respective beveled surface, and wherein each said shank projects through and laterally of the exterior sides of the respective pair of said corner elements, and said shank having on one end thereof a fixed handle adapted for gripping by a user's hand for manual rotation of said shank to cause said expansion and said retraction movements of the respective of said pair of corner elements, whereby said frame can be readily increased or decreased in size from exteriorly thereof.

2. A frame in accordance with claim 1 wherein a series of selected lengths of side frame elements are provided whereby the normal size of the frame can be varied by varying the selected length of the side frame elements chosen to form said frame, and in combination with a package container receiving said frame components therein.

3. A frame in accordance with claim 1 wherein said corner elements are elongated members received in slip fit telescoped condition with the respective side frame element, the first mentioned means comprising an opening in each corner element extending generally transversely thereof and aligned with a complementary opening of said series of openings in the respective side frame element and receiving a removable pin through said aligned openings for connecting each corner element to the associated side frame element, each of said tubular side frame elements at the ends thereof being provided with a recess projecting in the general direction of elongation of the respective side frame element, and providing clearance between the respective side frame element and the respective shank of the actuating means, which extends through said recess in the fully contracted condition of the the frame.

4. A frame in accordance with claim 1 wherein said corner elements are elongated members received in slip fit telescoped condition with the respective side frame element, the first mentioned means comprising a series of spaced openings in each corner element oriented lengthwise thereof and extending generally transversely of the respective corner element, one of said openings in said each corner element being aligned with one of said openings in the respective side frame element and receiving a removable pin through said aligned openings for connecting each corner element to the associated side frame element, said plurality of spaced openings in said each corner element providing for varying the telescoped position of each corner element with respect to its respective side frame element, each of said one-piece tubular side frame elements at the ends thereof being provided with recess means projecting in the general direction of elongation of the respective side frame element, and providing clearance between the respective side frame element and the respective shank of the actuating means which extends through said recess.

5. A frame in accordance with claim 4 in which the other end surface of each corner element extends generally perpendicular to the lengthwise axis of said corner element, said other end surface having a recess extending inwardly therefrom generally lengthwise of said corner element and terminating in said corner element short of said beveled end surface, at least some of said series of openings in said corner element communicating with said recess in said corner element for receiving therein associated fabric material attaching pins, and each of said tubular side frame elements at the ends thereof being provided with a recess projecting in the general direction of elongation of the respective side frame element, and providing clearance between the respective side frame element and the respective shank of the actuating means, which extends through said recess in the respective side frame element.

6. A relatively lightweight frame for stretching or blocking fabric material secured thereto comprising one-piece elongated defining side frame elements of tubular metal, a coacting pair of corner elements which are selectively expandably movable and contractibly movable relative to one another, each of said pairs of corner elements coacting between an adjacent pair of said one-piece side frame elements at the latters' adjacent ends and coupling the adjacent side frame elements together, each of said corner elements of each of said pairs of corner elements comprising a beveled end surface, with said end surfaces being disposed in generally confronting relation, means detachably coupling said side frame elements to the respective pair of said corner elements, rotatable actuating means coacting between each pair of said corner elements for expanding and contracting the corner elements of the respective pair away from and toward one another so as to selectively cause an increase or decrease in the frame size, said actuating means comprising a rotatable threaded shank provided with lefthand and righthand threaded portions, one of said corner elements of each of said pairs having a righthand threaded opening thereon while the other corner element of each of said pairs has a lefthand threaded opening thereon adapted for coaction with the respective of said righthand and lefthand threaded portions of said shank, thus providing for said expansion movement and retraction movement of the corner elements of each pair relative to one another upon rotation of said shank in a predetermined direction, said threaded openings extending inwardly from the respective of said beveled end surfaces generally perpendicularly thereto whereby said shank is disposed generally perpendicular to the respective beveled surface, and wherein each said shank projects through and laterally of the exterior sides of the respective pair of said corner elements, and each shank having on one end thereof a fixed handle adapted for gripping by a user's hand for manual rotation of said shank to cause said expansion and said retraction movements of the respective of said pair of corner elements, whereby said frame can be readily increased or decreased in size from exteriorly thereof, each pair of said corner elements having a guide pin projecting from the beveled surface of one of said corner elements of each said pair and being received in guided coaction in a complementary opening in the confronting beveled surface of the other corner element of said pair, to aid in guiding the corner elements toward and away from one another upon rotation of the respective shank as well as preventing the corner elements from twisting relative to one another, said handle projecting laterally of the respective shank and being engageable with the adjacent corner element or the adjacent side frame element to limit the withdrawal of said guide pin of each said pair from said complementary opening and thus prevent over expansion of the respective pair of corner elements, and each of said side frame elements having a series of generally lengthwise spaced openings therein adapted for removably receiving a respective pin-like member therein for rapidly attaching fabric to the side frame element along the respective side frame element.

7. A frame in accordance with claim 6 wherein said side frame elements, said corner elements and said rotatable actuating means are formed of corrosion resistant material, said corner elements are elongated and received in generally slip fit telescoped condition in the respective side frame element, each of said tubular side frame elements at the ends thereof being provided with a recess projecting in the general direction of elongation of the respective side frame element, so as to provide clearance between the respective side frame element and the respective shank of the actuating means which extends through said recess in the respective side frame element.

8. A frame in accordance with claim 7 wherein a series of selected lengths of said side frame elements are provided whereby the normal size of said frame can be varied by varying the selected length of the side frame elements chosen to form said frame, and in combination with a package container receiving said frame components therein.

* * * * *